US007275769B2

(12) United States Patent
Mills

(10) Patent No.: US 7,275,769 B2
(45) Date of Patent: Oct. 2, 2007

(54) ORGANIZATIONAL SYSTEM FOR REMOVABLY MOUNTING OR PERMANENTLY MOUNTING ON A SURFACE

(76) Inventor: Allison Marie Mills, 6012 Chapman Rd., Lorton, VA (US) 22079

( * ) Notice: Subject to any disclaimer, the term of this patent is extended or adjusted under 35 U.S.C. 154(b) by 504 days.

(21) Appl. No.: 10/874,933

(22) Filed: Jun. 23, 2004

(65) Prior Publication Data

US 2004/0262185 A1 Dec. 30, 2004

Related U.S. Application Data

(60) Provisional application No. 60/483,599, filed on Jun. 30, 2003.

(51) Int. Cl.
*G09F 9/00* (2006.01)

(52) U.S. Cl. ..... 281/31; 281/DIG. 1; 40/122; 19/52; 19/90; 248/683; 206/232

(58) Field of Classification Search ..... 281/31, 281/DIG. 1; 40/107, 122; 402/80 R; D19/52, D19/90; 434/238, 432; 248/683, 442.2; 211/70.1; 52/27, 38; 206/232; 428/81; 229/72; 383/39

See application file for complete search history.

(56) References Cited

U.S. PATENT DOCUMENTS 4,287,676 A * 9/1981 Weinhaus ..... 40/661.01
4,451,067 A * 5/1984 Williams ..... 281/31
4,575,126 A * 3/1986 Grubbs ..... 283/38
4,636,179 A * 1/1987 Gentile et al. ..... 402/79
4,794,711 A * 1/1989 Christensen ..... 40/122
4,802,575 A * 2/1989 Martin ..... 206/232
4,932,520 A * 6/1990 Ciarcia et al. ..... 206/232
5,141,485 A * 8/1992 Welt ..... 493/210
D333,485 S * 2/1993 Kogutt ..... D19/32
5,348,347 A * 9/1994 Shink ..... 281/31
5,351,992 A * 10/1994 Chilson et al. ..... 281/31
D396,490 S * 7/1998 Jack ..... D19/52
5,788,073 A * 8/1998 Suryk ..... 206/425
5,833,330 A * 11/1998 Kos ..... 312/209
5,948,498 A * 9/1999 Bianco et al. ..... 428/81
6,079,614 A * 6/2000 Ho ..... 229/67.1
6,443,415 B1 * 9/2002 Sundblad ..... 248/442.2
6,572,380 B1 * 6/2003 Buckley et al. ..... 434/238

(Continued)

*Primary Examiner*—Erica Cadugan
(74) *Attorney, Agent, or Firm*—White-Welker & Welker, LLC

(57) ABSTRACT

The present invention is an organizational system, which includes filing pockets and writing surfaces and is designed to be either removably mounted on a surface using magnets or permanently attached to a surface via nails or tacks or otherwise. The invention allows the user to file and identify papers in a compact and readily accessible manner and to make notations and retain information in a readily accessible manner. The major elements consist of a front side that is comprised of a plurality of labeled pockets for the storage of items and may include a separate removable writing surface. The back side may also contain a plurality of secondary pockets for retaining magnets for mounting to a magnetic planar object such as a refrigerator door. The organizational system of the present invention, in a preferred embodiment, has four filling tabbed pockets and comes in a variety of colors. Included in the filings system is a color coordinated dry erase board, tabs, and a dry erase pen. The reusable dry erase board gives one a convenient area for writing notes and messages. Additionally the dry erase tabs allow one to name and rename each pocket as desired.

5 Claims, 3 Drawing Sheets

U.S. PATENT DOCUMENTS 6,767,215 B2 * 7/2004 Robertson ..... 434/432
7,153,254 B2 * 12/2006 Cordes ..... 493/210
2006/0220311 A1 * 10/2006 Campbell ..... 273/148 R

* cited by examiner

ORGANIZATIONAL SYSTEM FOR REMOVABLY MOUNTING OR PERMANENTLY MOUNTING ON A SURFACE

CROSS REFERENCE TO RELATED APPLICATIONS

This application claims priority from U.S. Provisional Patent Application Ser. No. 60/483,599, entitled "Organizational System for Removably Mounting or Permanently Mounting on a Surface", filed on Jun. 30, 2003.

FEDERALLY SPONSORED RESEARCH

Not Applicable

SEQUENCE LISTING OR PROGRAM

Not Applicable

TECHNICAL FIELD OF THE INVENTION

The present invention relates generally to display boards and hanging file systems. More specifically the present invention relates to a hanging filing for conveniently organizing and displaying contents while also providing an additional display surface.

BACKGROUND OF THE INVENTION

Families everywhere routinely take part in a near hopeless quest to keep abreast of a rising tide of details related to everyday living. This is a task rendered even more daunting when activities of busy children add to the mix. Similarly challenged individuals in offices, dormitories, church meeting halls and so on, wherever people must cope with an endless flow of informational items. These items typically arrive in all shapes and sizes ranging from memoranda or multi-page reports, to tiny paper slips such as prescriptions, dental exam reminders, drycleaner tickets, and receipts.

Typically, families have used doors and the sides of refrigerators much like a home office desk. Often they hang pictures, menus, phone numbers, coupons, event schedules, or other paper items using magnets to hold them in place. As the family grows and the children become school age and join in more activities the family is soon inundated with paper notices for such things as PTA meetings, homework assignments, field trip permission forms, team rosters and schedules, game dates, and the like.

The demands on a central information location such as a refrigerator door or desk where papers are piled or attached to via magnets can quickly become an unorganized and unsightly mess. Thus, it is desirable for one to have an organization system where papers can be stored for quick and convenient retrieval with respect to a variety of subjects, classifications, persons, or other grouping.

Another problem in the prior art is the inability for one to quickly leave a note or reminder near or about the same central information location, such as the refrigerator door. In the prior art it is known to utilize a white board that attaches to a wall in the home or office environment, but there has been no to combine the need for organization storage and retrieval of paper in combination with the need for reusable message space.

A common shortcoming found in the prior art of similar organizational and display devices is the lack of a built in organizational structure for the materials retained therein. While other organization and display devices have attempted to solve this problem their organization and storage systems are difficult to use, in that the storage and retrieval of materials is difficult and time consuming and offers no way for one to quickly scan or file through the contents of individual organization or storage compartments.

What is needed is a time saving organizational system that may conveniently mount to a refrigerator or other planar surface to organize materials placed thereon, provide a expedient system for identifying and locating such materials even if covered up, and provide a peripheral writing surface for the recording of notes.

SUMMARY OF THE INVENTION

In accordance with the present an organization system is provided which overcomes the aforementioned problems of the prior art.

The present invention is an organizational system, which includes filing pockets and writing surfaces and is designed to be either removably mounted on a surface using magnets or permanently attached to a surface via nails or tacks or otherwise. The invention allows the user to file and identify papers in a compact and readily accessible manner and to make notations and retain information in a readily accessible manner.

The organizational system of the present invention, in a preferred embodiment, has four filing tabbed pockets and comes in a variety of colors. Included in the filing system is a color coordinated dry erase board, tabs, and a dry erase pen and attachment. The reusable dry erase board gives one a convenient area for writing notes and messages. Additionally the dry erase tabs allow one to name and rename each pocket as desired.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Referring to the figures, it is possible to see the various major elements constituting the apparatus of the present invention. The invention is an organizational system. The major elements consist of a front side that is comprised of a plurality of labeled pockets for the storage of items and may include a separate removable writing surface. The back side may also contain a plurality of secondary pockets for retaining magnets for mounting to a magnetic planar object such as a refrigerator door. A preferred embodiment of the present invention is described herein and shown in FIGS. 1-3.

Figure 1:
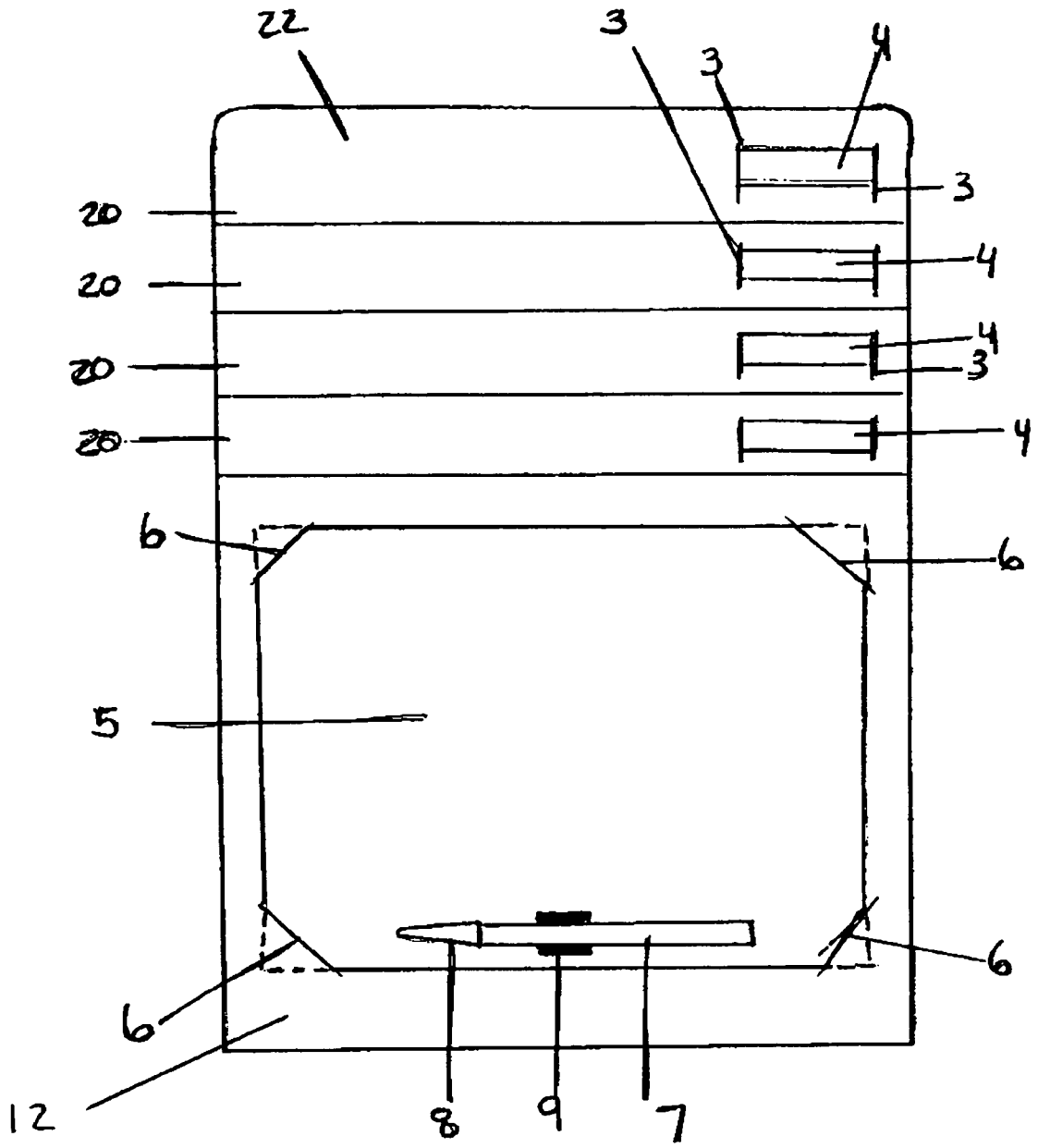
FIG. 1 is a front view of the organizer (22) of the present invention.
Figure 2:
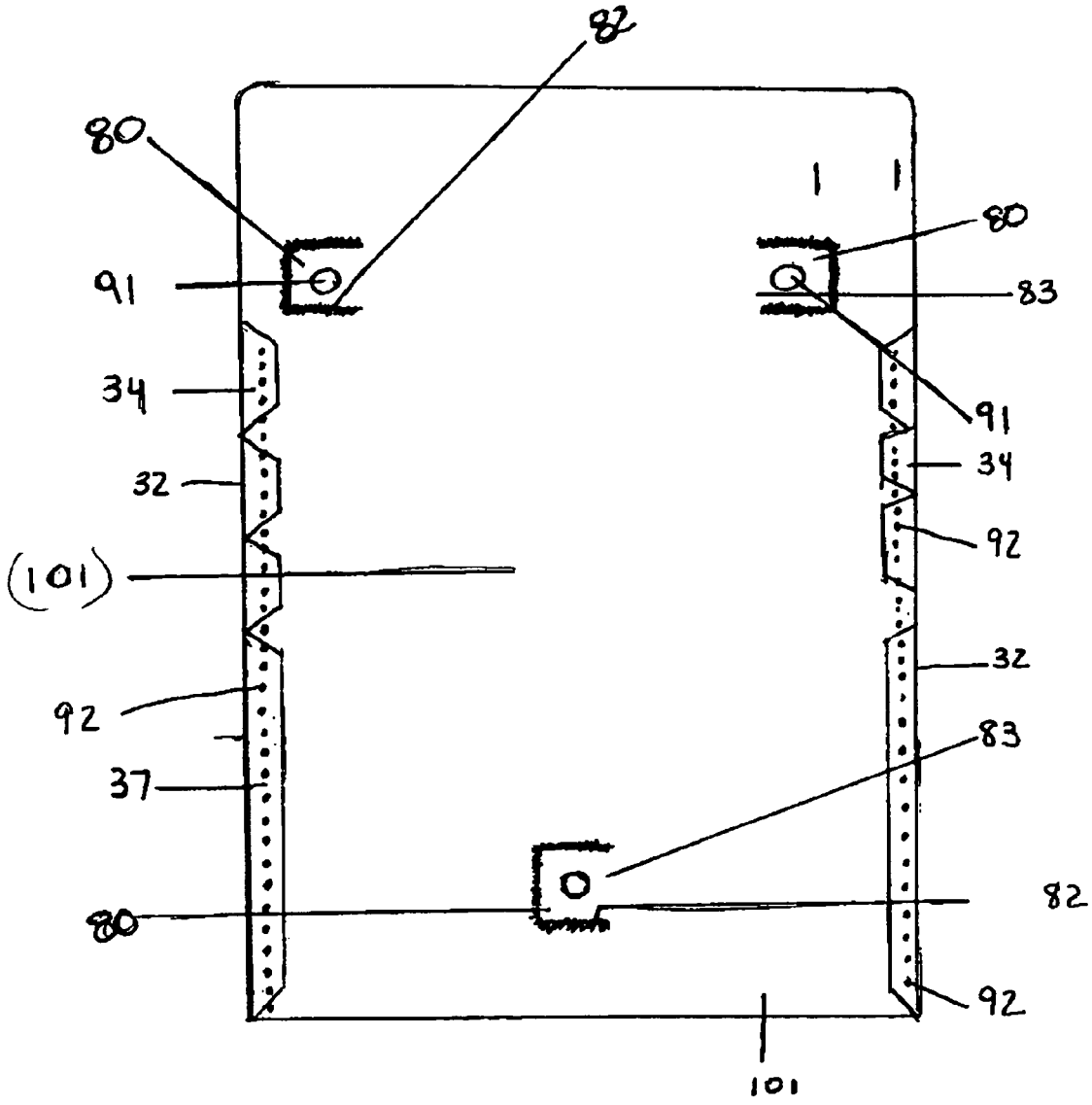
FIG. 2 is a rear view of the organizer (22) of the present invention.
Figure 3:
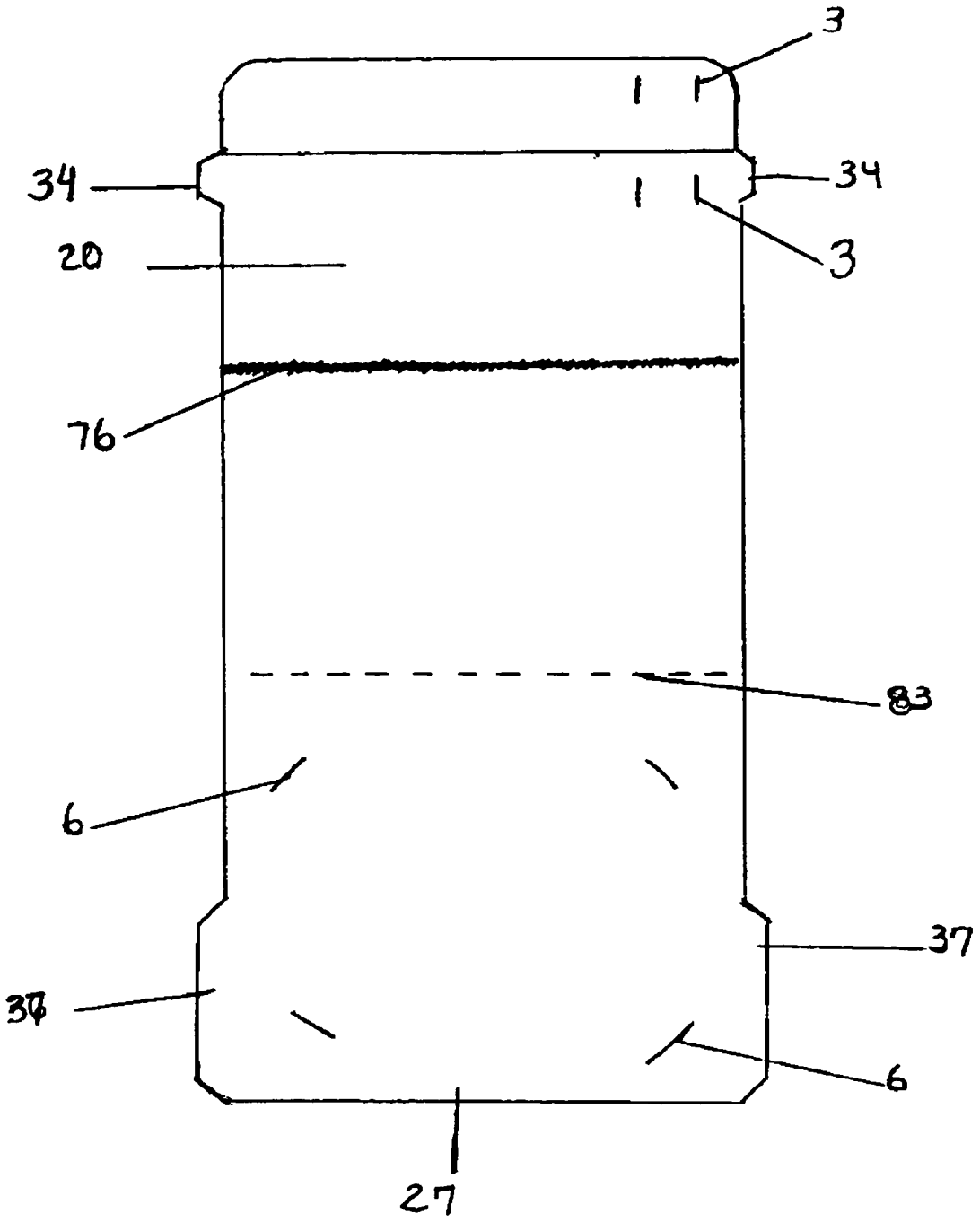
FIG. 3 is a drawing of the assembly process for the organizer (22) of the present invention.

Now referring to FIGS. 1-3, a magnetic refrigerator organizer, generally designated (22) is provided for filing and organizing material in a manner while providing another surface for recording notes and the like. The organizer (22) generally can be constructed of any suitable material, especially a suitable polymeric material, such as polyethylene. The organizer can be any variation of width and length. In one embodiment, the organizer measures 19"×12".

Generally, the organizer (22) consists of a front side (12) and a back side (101). The front side (12) of the organizer (22) includes pockets (20) that are sized to hold articles of paper such as forms, flyers, receipts, etc. or other items as needed. The pockets (20) are secured to the front side (12) of the organizer in a staggered arrangement. As such, a first pocket (20) is secured to the front side (12), and then a second pocket (20) is secured to the front side (12) a slight distance below the first pocket (20), and so on until the predetermined number of pockets (20) are mounted to the front side (12) of the organizer. The pockets (20) can be secured in a variety of ways. In one embodiment, the pockets (20) may be sonic welded along a bottom edge (76) of each pocket. Pockets (20) may have an overlap (34) along the sides of the organizer (22). This overlap (34) is located on the top portion of the pocket (20) and beginning at the top of the pocket and measuring down. In this embodiment, the length of the overlap (34) is 2½ inches long by 2 inches wide. During manufacturing, this overlap (34) is tucked around to the back side (101) of the organizer (22) and secured in an appropriate manner.

On each pocket (20) are two slits (3) that can be a variety of widths and distances apart from each other. In this embodiment, the slits (3) are ¾ inches by 1¾ inches apart. In this embodiment, they are shown to be located on the right side of the pocket. However, they can be located anywhere along the face of each pocket. The slits (3) secure a writing surface (4), such as dry erase tabs, or any other suitable writing surface. The writing surface (4) is designed to allow the user to write on the pocket, such as to identify the use of the pocket (20) by writing a name on the pocket.

The front side (12) also includes four slits (6) on a lower portion of the organizer. They are cut on a diagonal and to a predetermined angle in order that they may be used to hold a separate writing area 5, such as a dry erase board. The separate writing surface (5) goes into place and is held on to the front side (12) of the organizer (22) by sliding the corners of the separate writing surface (5) in the slits (6). A writing instrument (7), such as a dry erase pen (7) and cap (8) are attached to any portion of the writing surface (5) or the organizer (22) by a self-adhering product, such as VELCRO.

In another embodiment of the invention, not illustrated in the figures, the front side (12) may include a single slit (not shown) on a lower portion of the organizer that is cut on horizontally across the front side (12) running parallel to pocket openings. In this embodiment one could readily place a note pad or other writing surface (5) onto the front side (12) of the organizer (22) which would be held on to the front side (12 )of the organizer (22) by sliding in a the back few sheet or cardboard backing of the a writing pad such as a notebook into the single horizontal slit.

The back side (101) of the organizer consists of secondary pockets (80). The secondary pockets (80) can be of any number and any size. In this embodiment, secondary pockets are 1 inch by 1 inch. The secondary pockets (80) include three-sides (82), such that each is closed along the top, down the adjacent side and across the bottom of the secondary pocket (80). The secondary pockets can be made with any suitable material, such as a polymeric material, and closed in an appropriate way, such as through sonic welding. A magnet (91) is placed inside the secondary pocket using an open side (83) of the secondary pocket (80). This provides the needed magnetism to secure the organizer to any magnetic surface.

In this embodiment the organizer (22) is constructed by assembling several pieces of a polymeric material, such as polyethylene. It begins with a long strip (27)of this material, cut in a design fashion, which includes overlaps (37) on the bottom portion of the strip. Slits (3) are then added to the long strip (27) in pre-designated areas. The predetermined number of pockets (20) are added to the long strip (27) by the use of sonic welding (76). The pocket (20), includes a design feature that known as an overlap (34). The pocket (20) is laid in place on the long strip (27) and sonic welded (76) along the bottom edge of the pocket (20). The process is repeated for each number of pockets 20 added to the main strip (27). After this part of the assembly process is finished the bottom portion of the long strip (27) is folded up at predetermined length (83). The bottom overlaps (37) are folded at the edge (32) of the organizer (22) and are laid flat at the back 101 of the organizer (22). The overlaps (34) of each pocket are folded at the edge (32) of the organizer (22) and laid flat on the back (101) of the organizer (22). After all of the pockets (22) are in place, all of the overlaps (34) and (37) are sonic welded (92) along an edge to close the organizer.

In this embodiment, once the organizer (20) is constructed, the user then inserts the provided writing surface 4 into each designated slit (3) on each pocket (22). The user then inserts the writing surface (5) into the designated slits (6). The user the attaches the writing instrument (7) and (8) to any surface of the organizer (20) by use of a self-adhering product (9) such as VELCRO.

The user then may insert the magnets (91) into the secondary pockets (80) on the back side (101) of the organizer (20) through the opening (82) in the secondary pocket. The organizer can now be used on a removably mounted surface. Another option for the user is to hang the organizer (20) by nails, tacks or otherwise on a permanently mounted surface.

It is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiment of the invention in which an exclusive property or privilege is claimed are defined as follows:

1. An organizing system comprising:

a organizer frame including a front side and a back side;

said front side having one or more slits on a lower portion of the organizer frame so that they may be used to hold a separate writing area;

a writing instrument consisting of a self-adhering product is attached to any surface portion of the writing area by the self-adhering product;

a plurality of pockets attached to said front side of said organizer frame;

a first pocket is secured to the front side, and then a second pocket is secured to the front side at a desired distance below the first pocket;

the addition of pockets is repeated until any predetermined number of pockets are mounted to the front side of the organizer; and the pockets each have an overlap overlapping from the front side to the back side and located along the sides of the organizer frame, said overlap is located on a top portion of each pocket and beginning at a top corner of each pocket and continuing down a side portion of each pocket.

2. The organizing system of claim 1, wherein the length of at least one of the overlaps is 2½ inches long by 2 inches wide and is tucked around to the back side of the organizer frame and secured.

3. The organizing system of claim 1, wherein each pocket is further comprised of two slits that can be a variety of widths and distances apart from each other;

the slits secure a writing surface; and said writing surface is a dry erase tab designed to allow a user to write on the pockets.

4. The organizing system of claim 1, wherein the back side of the organizer consists of a plurality of secondary pockets;

said secondary pockets having three-sides, such that each is closed along a top, down an adjacent side and across a bottom of the secondary pocket leaving one open side;

a magnet is placed inside each of said secondary pockets utilizing the open side of said secondary pocket; and said secondary pockets are sealed after the insertion of said respective magnet.

5. The organizing system of claim 4, wherein the secondary pockets are 1 inch by 1 inch.

* * * * *